US005485256A

United States Patent [19]

Randall et al.

[11] Patent Number: 5,485,256

[45] Date of Patent: Jan. 16, 1996

[54] METHOD AND APPARATUS FOR FORMING COMBINED TONER IMAGES

[75] Inventors: Kent A. Randall, Webster; Francisco L. Ziegelmuller, Penfield; Dennis R. Kamp, Spencerport; Sven Sonnenberg; Donald S. Rimai, Webster, all of N.Y.

[73] Assignee: Eastman Kodak Company, Rochester, N.Y.

[21] Appl. No.: 180,580

[22] Filed: Jan. 12, 1994

[51] Int. Cl.[6] ..... G03G 15/01

[52] U.S. Cl. ..... 355/271; 430/44; G03G/15/01

[58] Field of Search ..... 355/200, 244, 355/271, 274, 326 R, 327; 430/126, 44

[56] References Cited

U.S. PATENT DOCUMENTS

| | | | |
|---|---|---|---|
| 4,183,655 | 1/1980 | Umahashi et al. | 355/3 TR |
| 4,607,935 | 8/1986 | Kindt et al. | 355/3 TR |
| 4,796,047 | 1/1989 | Fowlkes et al. | 355/3 TR |
| 4,797,703 | 1/1989 | Guslits | 355/3 DD |
| 4,884,106 | 11/1989 | Harris | 355/212 |
| 5,016,062 | 5/1991 | Rapkin | 355/327 |
| 5,040,026 | 8/1991 | Jamzadeh et al. | 355/271 |
| 5,070,372 | 12/1991 | Randall | 355/272 |
| 5,075,730 | 12/1991 | Hoshi | 355/271 |
| 5,079,597 | 1/1992 | Mauer et al. | 355/303 |
| 5,084,735 | 1/1992 | Rimai et al. | 355/271 |
| 5,087,939 | 2/1992 | McDougal | 355/200 |
| 5,124,757 | 6/1992 | Ikegawa | 355/296 |
| 5,132,738 | 7/1992 | Nakamura et al. | 355/274 |
| 5,182,604 | 1/1993 | Asai | 355/273 |
| 5,187,526 | 2/1993 | Zaretsky | 355/273 |
| 5,253,022 | 10/1993 | Takeuchi et al. | 355/274 |

FOREIGN PATENT DOCUMENTS

| | | | |
|---|---|---|---|
| 3-251860 | 11/1991 | Japan | 355/326.4 |
| 4-233557 | 10/1992 | Japan | 355/200 |

*Primary Examiner*—Joan H. Pendegrass
*Attorney, Agent, or Firm*—Leonard W. Treash, Jr.

[57] ABSTRACT

First and second toner images are created on a primary image member. The first toner image is transferred to an intermediate image member and then transferred back to the primary image member to combine the two images. Preferably, the intermediate image member is a light roller that is inarticulatable and maintained in contact with the primary image member which is preferably an endless belt with sufficient wrap to drive the intermediate image member with low pressure in the contact nip. Cleaning is effected by transferring residual toner back to an empty portion of the primary image member from where it may be cleaned off by a primary image member cleaning station. Intrack registration of the images is maintained by adjusting the time between flashes in creating the two images.

28 Claims, 4 Drawing Sheets

METHOD AND APPARATUS FOR FORMING COMBINED TONER IMAGES

This invention relates to the formation of combined toner images. Although not limited thereto, it is particularly useful in creating accent color images in office copiers and printers. It can also be used to combine toner images of the same color or to make full color images.

U.S. Pat. No. 5,070,372, granted Dec. 3, 1991, describes methods and apparatus in which first and second toner images are formed on a primary image member. The first toner image is transferred to an intermediate image member and then back to the primary image member in registration with the second toner image to form a combined toner image on the primary image member. The combined toner image can be transferred to a receiving sheet in a single step.

This method can be used in a variety of ways. For example, it can be used to combine two images of the same color from different originals, two images of different color from the same or different originals, two images of the same color but different toners, for example, magnetic and non-magnetic toners, or two images formed by different means, for example electronic and optical means of the same or different toners and colors.

It can be used to combine more than two images by transferring first and second (or more) images in registration to the intermediate image member before they are transferred together back to the primary image member. It has excellent registration and minimal paper handling. It uses low cost components.

U.S. Pat. No. 5,075,730, granted to Hoshi Dec. 24, 1991, shows an endless web photoconductor which works in combination in some embodiments with an intermediate web to combine toner images for transfer to a receiving sheet; see, especially, FIGS. 19, 20 and 21.

U.S. Pat. No. 5,016,062, granted to Rapkin May 14, 1991, shows a number of embodiments using an intermediate for accumulation of images, which intermediate can also be a photoconductive web for forming primary images which are used in most embodiments to form masters for xeroprinting.

U.S. Pat. No. 5,079,597 to Mauer, granted Jan. 7, 1992, shows a scheme for cleaning an intermediate transfer roller involving transferring the toner on the intermediate back to a photoconductive web in between images for cleaning by the primary cleaning mechanism for the web. Other similar disclosures include U.S. Pat. No. 5,253,022 to Takeuchi et al, Oct. 12, 1993; U.S. Pat. No. 5,132,738 to Nakamura et al, granted Jul. 21, 1992; U.S. Pat. No. 5,124,757 to Ikegawa, granted Jun. 23, 1992; U.S. Pat. No. 5,182,604 to Asai, granted Jan. 26, 1993; and U.S. Pat. No. 4,183,655 to Umahashi, granted Jan. 15, 1980.

U.S. Pat. No. 5,084,735, granted to Rimai et al Jan. 28, 1992, suggests various materials for intermediate transfer members, including members coated with an outer thin layer of relatively hard material. See also, U.S. Pat. No. 5,187,526 to Zaretsky, Feb. 16, 1993.

U.S. Pat. No. 5,087,939 to McDougal, granted Feb. 11, 1992, shows an intermediate transfer drum which is driven by a motor which, in turn, frictionally drives a photoconductive drum in a cartridge. The reverse is also known, see, for example, U.S. Pat. No. 5,040,026, granted to Jamzadeh et al Aug. 13, 1991.

U.S. Pat. No. 4,884,106, issued Nov. 28, 1989 to Harris shows use of a variable delay for intrack registration of toner images formed by a flash exposure on a photoconductive belt. The images are combined on a receiving sheet mounted on a transfer roller driven by gearing between a belt support roller and the transfer roller.

U.S. Pat. No. 4,796,047 to Fowlkes et al, granted Jan. 3, 1989, suggests a soft, relatively unbacked nip for transfer from a web to both a sheet supported by a roller and to an intermediate roller itself. See also, U.S. Pat. No. 4,607,935 to Kindt et al, granted Aug. 26, 1986.

SUMMARY OF THE INVENTION

It is an object of the invention to improve the method and apparatus disclosed in U.S. Pat. No. 5,070,372, especially in a manner which allows the invention to be accomplished with simple and reliable components. U.S. Pat. No. 5,070,372, referred to above, is hereby incorporated by reference herein.

This and other objects are accomplished by several schemes which may be used separately or in combination. First, the intermediate image member is driven by frictional contact with the primary image member. This eliminates the necessity for a separate drive for the intermediate image member and actually reduces registration error. Secondly, the intermediate is cleaned by a transfer of toner back to the primary image member periodically during the use of the intermediate image member. This feature has several advantages. It eliminates the need for a cleaning station which must be articulated. Secondly, it prevents a drag on the intermediate caused by a cleaning station which would, in turn, be passed on to the frictional contact between it and the primary image member which is driving it. Thirdly, the intermediate image member is maintained in a transfer relation with the primary image member, even though the intermediate image member is not being used, for example, when images are being produced without combining images. This has the advantage of eliminating an articulation structure for the intermediate itself.

Although each of these features improve the cost and reliability of the intermediate image member in their own fight, when taken together, the second and third features greatly reduce the drag that the module puts on the image member itself, thereby facilitating it being driven by the primary image member.

According to a further preferred embodiment, the intermediate image member is a very thin metallic roller covered by one or more nonmetallic layers. According to this embodiment, the outer layer has a Youngs modulus in excess of $5\times10^7$ Newtons per square meter, preferably in excess of $10^8$ Newtons per square meter. This roller facilitates good transfer while permitting driving of the roller with the primary image member.

According to a preferred embodiment, the primary image member is an endless belt and the intermediate image member is a drum having a continuous surface. Surprisingly, we have found that reliable transfer from the primary image member to the intermediate and back can be effected with materials having hard transfer surfaces, but the intermediate image member can, nevertheless, be driven by frictional contact with a very low pressure wrap of the intermediate image member. This remarkable result is due, in part, to the other features of the preferred embodiment which greatly reduce the drag that the intermediate image member places on the primary image member. We also believe the electrostatic fields associated with the process assist effective driving. The low pressure wrap, in addition to providing quality transfer, causes little pickup of and disturbance to uncombined images passing through the nip.

DESCRIPTION OF THE PREFERRED EMBODIMENTS

Figure 1:
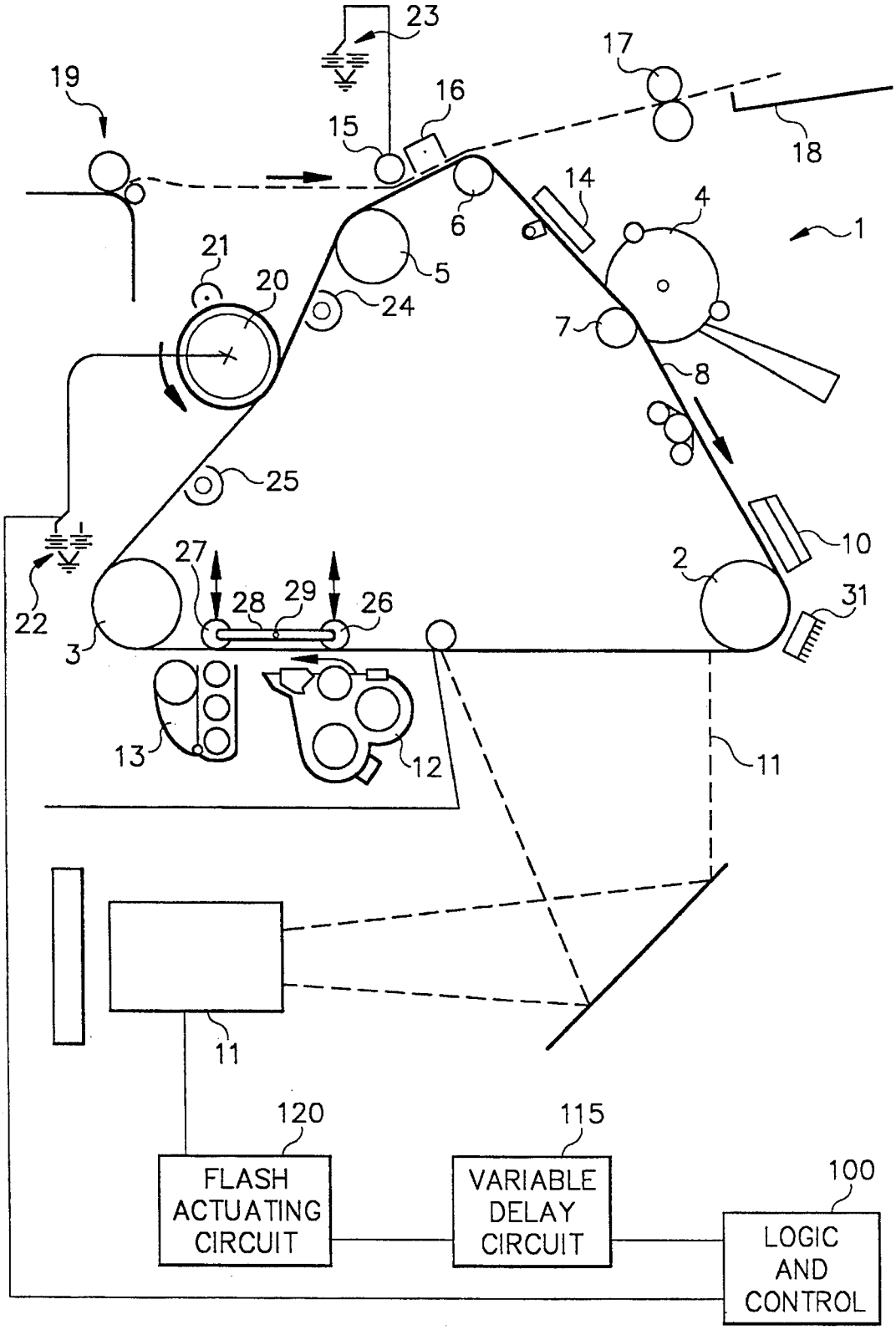
FIGS. 1, 2 and 4 are side schematics of alterative image forming apparatus.

FIG. 1 shows an image forming apparatus 1 for forming a series of toner images on receiving sheets using an electrophotographic process well known in the art. More specifically, a primary image member, for example, an endless photoconductive belt 8 is trained about a series of rollers 2, 3, 5, 6 and 7 for movement past a series of stations. It is frictionally driven by a drive roller 3 and its tracking is controlled with a conventional passive tracking system. One or more of the rollers is spring biased to maintain a desired tension on belt 8.

Primary image member 8 is uniformly charged by a corona charger 10. It is imagewise exposed by an LED printhead 31 or a conventional optical flash exposure device 11, or both, to create an electrostatic image. The electrostatic image is toned (developed) by one of two toning stations 12 and 13 to create a toner image. The color and other characteristics of the toner image will depend on the toner in the toning station which develops that particular electrostatic image. The toned image is transferred to a receiving sheet fed out of a receiving sheet supply 19 and into contact with the toner image carried on primary image member 8. Actual transfer is accomplished by an electrical field between a transfer roller 15 and primary image member 8. The receiving sheet is separated from primary image member 8 with the help of a detack corona 16 and the passage of primary image member 8 around a small roller 6. The receiving sheet proceeds to a fuser 17 where the image is fixed to the receiving sheet and finally into an output tray 18. As is well known in the art, the receiving sheet can be returned to the transfer station for receipt of another image, for example, an image on the opposite side to form a duplex image. It is also known to recirculate the sheet to place more images on the same side as the first image, which images can be of a different color than the first image. Primary image member 8 is cleaned by a conventional cleaning station 4 for reuse.

Typically, one of the toning stations, for example, station 12, contains black toner and the other station, station 13, contains an accent color, for example, red, blue, yellow, brown or the like. A given electrostatic image would be toned entirely in one color. The station which tones that electrostatic image is determined by the position of backup rollers 26 and 27, each of which is selectively movable to a position to push belt 8 into an operative position with respect to the toning stations. This particular type of structure is generally shown in U.S. Pat. No. 4,797,703 to Guslits, and is shown only schematically in FIG. 1. Basically, if lever 28 is rotated in a clockwise direction, backing roller 26 moves belt 8 into operative position with respect to black development station 12 and the electrostatic image passing station 12 is toned with whatever toner is in station 12, for example, black toner. Similarly, if lever 28 is rotated about pivot 29 in a counter-clockwise direction, backing roller 27 moves belt 8 into an operative position with respect to development station 13 and the electrostatic image passing it is toned with whatever toner is in station 13, for example, an accent color toner. Movement of one backing roller toward its station moves the other away from its station. For more details of such a structure, see the aforementioned Guslits patent. Many other approaches for selectively toning electrostatic images are known and can be used. For example, the stations can be moved themselves toward and away from the primary image member; toning valving systems can be used in stationary stations, and so forth, all of which are well known in the art.

Consecutive images formed on primary image member 8 are combined by the use of an intermediate image member 20 which operates generally as shown in U.S. Pat. No. 5,070,372. Preferably, intermediate image member 20 is an intermediate roller (sometimes called a "drum") having an intrack circumference approximately equal to the intrack length of a single frame or the pitch of images on primary image member 8. A reversible electrical power source 22 is connected to intermediate image member 20 for creating an electric field of each polarity with respect to primary image member 8. (Primary image member 8 typically has a backing to its photoconductive or insulating layers that is conductive and grounded.) The toner of each image is charged to a particular polarity for development of its electrostatic image. Because the toner is charged, it is capable of being moved by an electrical field. When the first toner image of a pair of images to be combined reaches intermediate image member 20, reversible power source 22 is switched to a condition creating an electric field urging the toner to member 20. The toner image will then be transferred to the periphery of intermediate image member 20. When the second toner image enters into close proximity with intermediate image member 20, the reversible power source 22 is moved to a condition creating an electric field which urges the toner back to the primary image member in registration with the second toner image. This creates a combined image. If the two images are of different color, the combined image is a multicolor or two color image. Three or more images can be combined in this manner by transferring to member 20 two or more images in registration in two (or more) revolutions of the intermediate image member 20 and then transferring the two or more images in one step back to the primary image member in registration with the next image. Transfer of the image back to the primary image member can be assisted by use of a corona charger 21 which supplies a corona which conditions the toner for the process.

As mentioned in the prior art, both the primary image member and the intermediate image member can be independently driven at the same speed. Alteratively, the intermediate image member can be driven through gearing driven by a roller supporting or driving the primary image member; see, for example, U.S. Pat. No. 4,884,106, referred to above. However, preferably, the intermediate image member is not independently driven, but is driven by frictional contact with the primary image member 8. Several advantages are gained by this approach. First, the cost of an independent drive is eliminated. Secondly, the need for a costly servo-system for maintaining the speed of the two image members constant is also eliminated. Third, even though the intermediate image member may vary in size as temperature and other ambient conditions change, the relative speeds of the surfaces of the image members will not change. Quite remarkably, we have found that using normal known organic photoconductive materials for the primary image member 8 and known surface materials for the intermediate image member 20, excellent transfer of the first image, first to the intermediate image member 20 and then back to the primary image member 8, can be obtained with materials that still have enough friction to facilitate a non-slipping drive between the surfaces. This is accomplished even though the nip between the two image members is relatively small and low pressure and the surfaces in question are smooth and hard. We believe the electrical fields in the nip, though varying, help the drive without requiring softer surfaces or more pressure.

Image forming apparatus 1 could be designed to be used primarily for the production of black simplex images with combined images made a minor portion of the time. Simplicity and reliability of intermediate image member 20 is further enhanced by not articulating it away from primary image member 8 when not combining images. The intermediate image member is left in contact with primary image member 8 even when the image forming apparatus is in a monocolor (or "noncombining") mode. This eliminates the need for an articulation mechanism and also provides consistency in the drive and tracking of primary image member 8.

To further simplify intermediate image member 20, no separate cleaning mechanism is provided. Instead, any residual toner remaining on its periphery is transferred back to primary image member 8 during an unused portion of primary image member 8, for example, a skip frame available or designed for that purpose. This feature not only eliminates an expensive component (an articulatable cleaning station), but also eliminates an element that would be a drag on the rotation of intermediate image member 20 and make more difficult driving of member 20 by belt 8.

The elimination of the cleaning station and the articulation mechanism for member 20, thus, are not only preferred for simplification and reliability improvement to the intermediate component, but they also eliminate elements that would make it more difficult to drive the intermediate image member frictionally with the primary image member.

Note also that the low drag on intermediate image member 20 and its electrostatic attraction to primary image member 8 permit driving it with low pressure in the driving nip. This low pressure (preferably less than 2 pounds per square inch, for example, 0.5 pounds per square inch) reduces the tendency of a monocolor image to be picked up, in pan, by intermediate image member 20 as it passes through the nip. If even a relatively small amount of a monocolor image is picked up, it may transfer to the next image, ruining that image.

The intermediate image member 20 can be spring biased into the belt 8. However, it is preferably fixed between the mechanism plates of the apparatus and the pressure in the nip is controlled by control of the overall tension of belt 8, generally by control of a bias applied to one of the other rollers. The electrical field contributes to the pressure which makes the pressure vary somewhat with the field.

To further contribute to the ease of driving intermediate image member 20, it is preferably provided with as little rotary inertia as possible. We have found that good results are achieved with an extremely thin, preferably less than 5 mm, for example, 1 mm, aluminum roller covered with an also somewhat thin, preferably less than 5 mm outer layer. (A very thin, for example 25 microns or less thick outer layer can be used.) The roller is mounted to be the predominant rotary component of intermediate image member 20 that is driven by primary image member 8.

For example, corona charger 10 provides a uniform negative electrostatic charge and a first electrostatic image is formed by either LED printhead 31 or flash exposure device 11 by exposing the background portions. This negative polarity electrostatic image is toned by station 12 containing black toner having a positive charge using charged area development to create a black toner image. A second negative electrostatic image, which may be formed also by either of stations 31 or 11, is toned by application of positive toner from station 13. A portion of the photoconductor is then skipped. For example, if the photoconductor is divided into dedicated frames, each of the first two images go on separate frames and a third frame is then skipped. If the frames are not dedicated, a portion equal to the intrack pitch of the images is skipped.

The black or first toner image is transferred to the outside of intermediate image member 20 with a bias applied to member 20 of −700 V with respect to a grounded primary image member to move the positive toner to the periphery of member 20. Reversible power supply 22 is reversed to +600 V and the black toner image is transferred back to primary image member 8 in registration with the second toner image. After the second toner image leaves the nip between the primary and intermediate image members, the reversible power supply is maintained in its reversed condition for another revolution during which any residual toner left on its surface is transferred to the skipped frame on primary image member 8.

Transfer roller 15 is also connected to a reversible power source 23. As the three frames pass transfer roller 15, roller 15 is grounded or positively biased by power source 23 to not pick up toner during passage of the first and third frames. As the second frame passes, a paper receiving sheet is between the image and the transfer roller, and the transfer roller is biased conventionally to create an electric field urging the transfer of toner from the primary image member to the receiving sheet. After the receiving sheet passes on to the fuser and into output tray 18, the primary image member 8 goes under a cleaning assist charger 14 which loosens any toner on the primary image member, and conventional cleaning station 4 which cleans all three frames. When monocolor images are formed (non-combining mode), the intermediate image member 20 is grounded or biased positively to not pick up toner in the nip.

An optional pretransfer erase 25 is shown in FIG. 1. It loosens the first image by dissipating some of the charge holding it. This loosening facilitates transfer using a lower bias on intermediate transfer roller 20 reducing ionization problems from higher voltages. The erase is turned off when the second image passes and when monocolor imaging is being done. An also optional second or primary erase 24 after the nip is left on to loosen the image for transfer at primary transfer roller 15.

According to one preferred embodiment, the outer layer of intermediate image member 20 is a single thin (less than 5 mm) layer of a relatively hard substance, such as a material marketed under the name Permuthane. This material has a Youngs modulus at room temperature of about $10^8$ Newtons/$m^2$ and is a known material for the outer surface of intermediates; see for example, U.S. Pat. Nos. 5,084,735 and 5,187,526, referred to above. Other similarly hard materials can also be used.

According to an alterative preferred embodiment, the hard material can be very thin, for example, less than 50 microns and be backed by a thin layer of a more compliant (Youngs modulus of $10^5$–$10^7$ Newtons/$m^2$) polyurethane.

In either example, it is preferred that the aluminum core be as thin as possible.

A conventional organic photoconductor used commercially with or without a protective overcoat, typically has a Youngs modulus in excess of $5\times10^7$ Newtons/$m^2$, usually about $10^9$ Newtons/$m^2$. Use of materials for the intermediate image member 20 with a Youngs modulus in excess of $5\times10^7$ Newtons/$m^2$ is preferred for complete transfers in both directions. However, such hard materials would be expected to slip in a driving relationship. Surprisingly, we have found that, even with a small, low pressure wrap of, for example, 0.5 pounds per square inch, intermediate image member 20 can be driven by primary image member 8 without slipping and with good transfer between the image members in both directions. We believe the electrostatic fields in the nip as well as the low inertia intermediate roller 20 facilitate this result.

As pointed out in U.S. Pat. No. 5,070,372, image forming apparatus 1 can be used to combine images of different color, images of the same color but of different toners (for example, magnetic and nonmagnetic black toners) or images of the same toner made from different originals.

The particular mechanism shown for determining which development station tones each image has simplicity and reliability advantages. Nevertheless, while it can switch readily from toning with station 12 to toning with the downstream station 13, it cannot immediately switch back to the upstream station until the downstream station has finished its toning. Thus, with this particular structure, it is convenient to place a skip frame, or at least a portion of a skip frame, immediately after use of the downstream station. Thus, with this particular apparatus, using a skip frame for cleaning intermediate image member 20 does not cause a loss in productivity of the apparatus.

Although one could be used, preferably, there is no roll or other member directly backing the primary image member 8 in its nip with intermediate image member 20. This results in a relatively soft, low pressure nip. Some wrap of the primary image member around member 20 both improves the quality of the transfer and also provides more contact for driving member 20 at the low pressure.

When no image combining is being done, for example, when monocolor images from a single original are being formed on a receiving sheet, power source 22 applies a ground or a bias inhibiting transfer of toner to intermediate transfer member 20. In the example above, this is a bias of +300 V. The low pressure is also important in preventing degradation of images going through the nip when image combining is not being performed. The substantial pressure provided by a backup member has a tendency to cause toner in such images to adhere to the surface of member 20 and redeposit on subsequent frames, even though the substantial electrical field in the nip inhibits such a pickup of toner on member 20. Thus, the low pressure and substantial nip allow driving of the member 20 by frictional contact while inhibiting transfer of an uncombined image. For a further discussion of other advantages of low pressure nips, see U.S. Pat. No. 4,796,047, referred to above.

This scheme is capable of extremely accurate registration of images, which registration is especially good when the two images being combined are both formed by the same exposing device, for example, flash exposing device 11 or electronic exposing device 31. When the invention is used to combine an image made from each of the exposing devices, then registration is dependent upon the registration between the two devices. Assuming that the two (or more) images are made with one or the other of the exposing devices, crosstrack and skew registration will be extremely accurate, providing the web 8 does not change its direction substantially between exposures. Experience has shown that, with conventional, well designed, tracking systems, crosstrack and skew registration is excellent.

Intrack registration is dependent upon the timing of the exposures. It can also be affected by the circumference of intermediate image member 20, which, in turn, can vary with changes in ambient conditions, especially temperature. FIG. 1 illustrates a preferred approach to controlling intrack registration of two images formed by flash exposure device 11. Flash exposure device 11 is actuated by a flash actuating circuit 120, whose timing is controlled by a logic and control 100. A variable delay circuit 115 is positioned between logic and control 100 and flash actuating circuit 120. This delay circuit is set up to delay the flash by a small amount, which amount is, in turn, variable by the operator. If the images being combined are the results of consecutive flashes of flash exposing mechanism 11, intrack registration is adjusted by adjusting the time between the flashes. This is accomplished by making either, or both of the flash timings variable and operator adjustable. For example, the second flash is made adjustable. (In two color imaging with the FIG. 1 apparatus, the second flash controls the positioning of the toner image developed with color development station 13.) If the operator notices, from inspection of the output, that the color image is offset in the intrack direction from its desired position with respect to the black image, then he would adjust the delay provided by variable delay circuit 115 until a satisfactory registration is obtained. Obviously, this can be accomplished by a registration knob on the control panel or by a set screw only accessible to a serviceperson. The desirability of having this function available to the operator depends on the variability of the registration which may, in turn, depend on the variety of ambient conditions to which the apparatus is subjected. In most instances, the registration can be set by the service personnel and acceptable registration is obtained until the next service call. This approach is similar to that shown in U.S. Pat. No. 4,884,106 to Harris, issued Nov. 28, 1989, which patent is hereby incorporated by reference herein.

Figure 2:
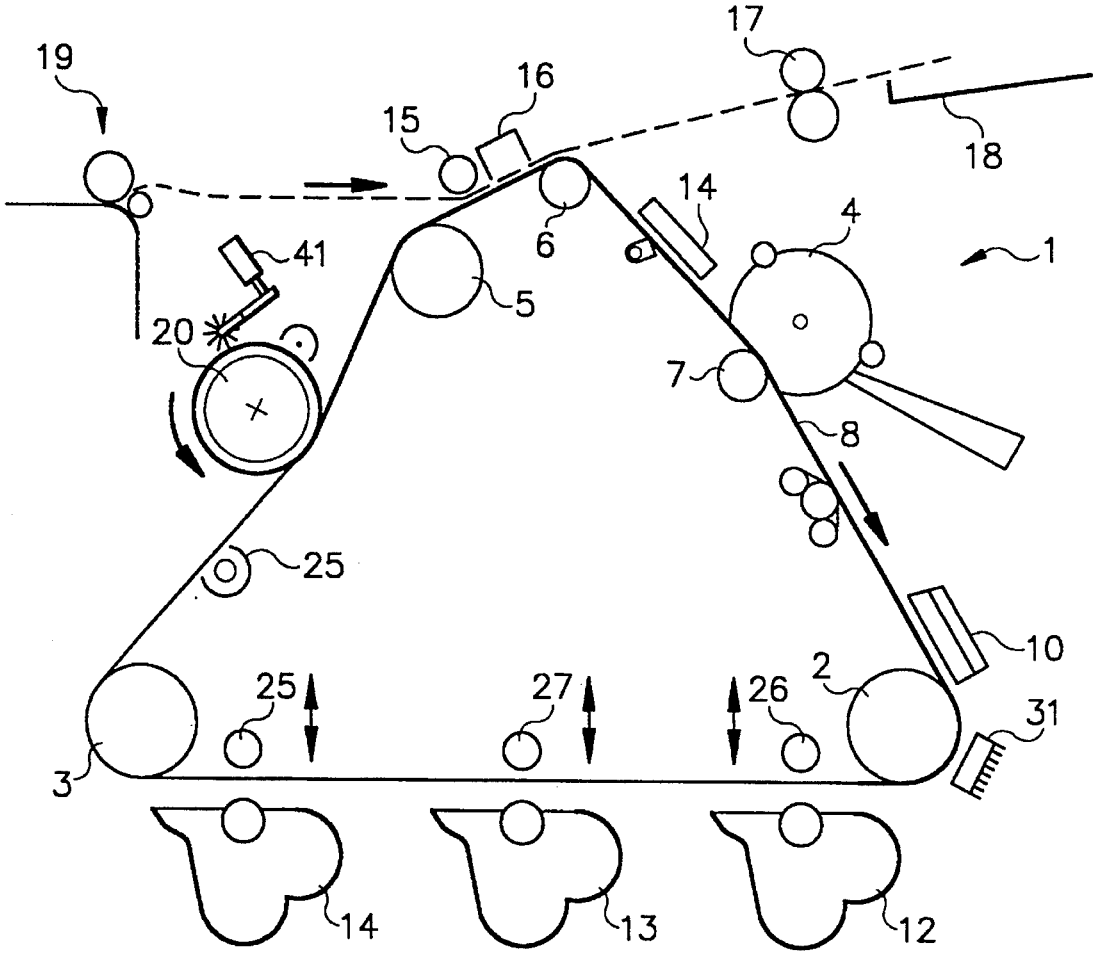

FIG. 2 shows an apparatus similar to that shown in FIG. 1. All exposures are made by electronic exposure device 31. In this approach, with the elimination of flash exposure device 11 (FIG. 1) them is room for three full sized development stations 12, 13 and 14. Because electronic exposure is used, development is preferably of the discharged areas with the appropriate adjustment in transfer biases by power sources 22 and 23 (FIG. 1). Two or more images can be accumulated on intermediate image member 20, facilitating three color combined images on primary image member 8.

An articulatable cleaner 41 has been added to clean the exterior of intermediate image member 20 immediately after transfer of the image or images back to primary image member 8. This additional cleaning device provides the advantage of not using a skip frame for cleaning. It is, thus, best utilized by making movable backing rollers 25, 26 and 27 independently operable so that development stations 12, 13 and 14 can be continuously altercated. Further, with some materials, it may be desirable to continually clean the intermediate image member 20 when it is not combining images, that is, for example, when image forming apparatus 1 is making a series of images with a single electrostatic image. Note, however, that the articulatable cleaner 41 has the disadvantage of increasing the drag on rotation of intermediate image member 20 which, in turn, makes it more difficult to be driven by primary image member 8.

Figure 3:
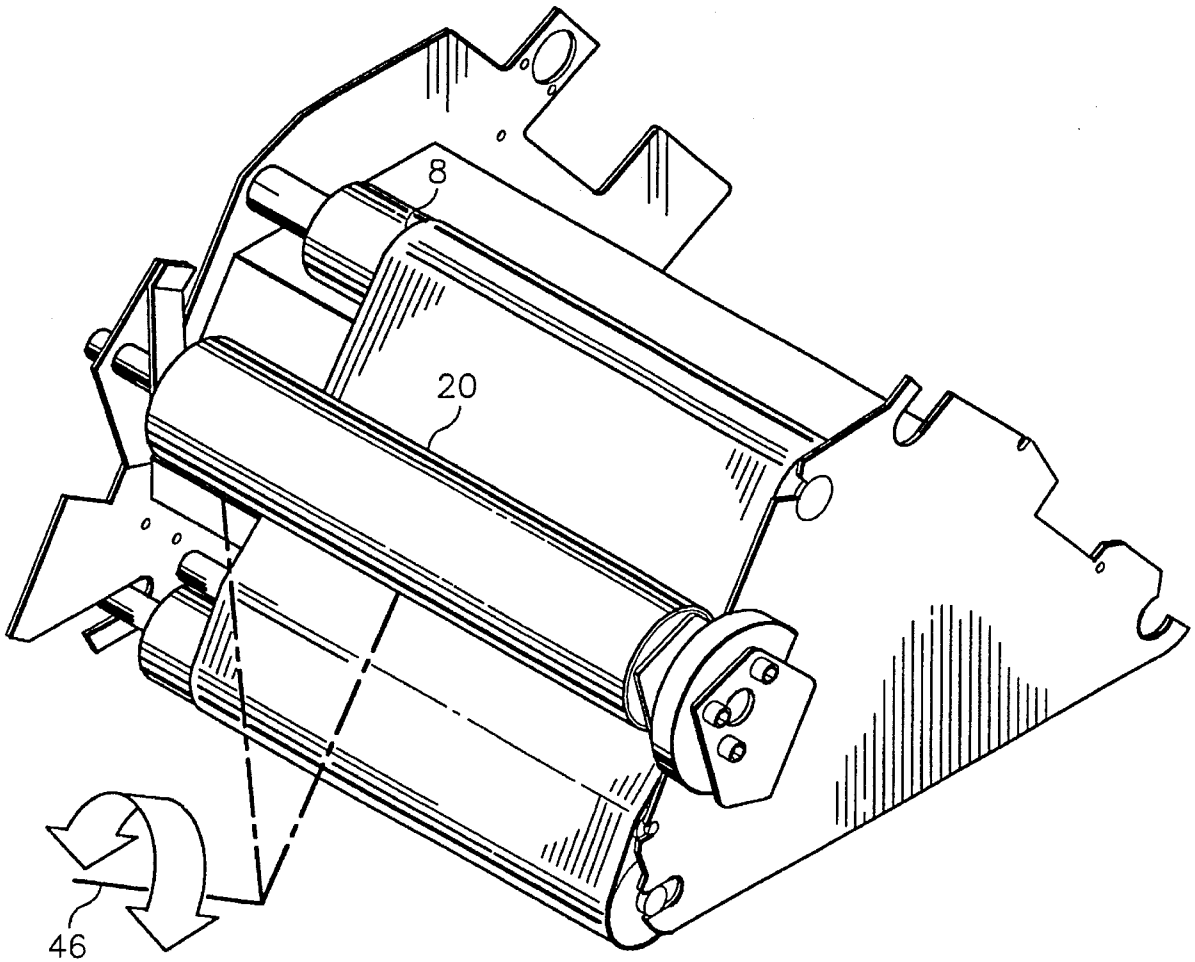
FIG. 3 is a perspective view of an intermediate image member and a portion of a primary image member.

The amount of wrap in the nip between the image members 8 and 20 is something to be determined empirically for each system. We have found that a fair amount of wrap provides low pressure, slip-free driving of intermediate image member 20 by primary image member 8 with reasonable quality and more complete transfer. However, excessive wrap has an effect on the tracking of an endless belt under tension which must be considered in the overall tracking approach of the apparatus. The low pressure also assists in tracking. FIG. 3 shows a portion of a film core for primary image member 8. Intermediate image member 20 is mounted on a gimballed bearing and is castered about a caster axis 46, positioned substantially upstream of member 20. With this structure, the roller does not adversely affect tracking with a wrap of approximately 10° and with the web tracking system already in place for prior apparatus from which the FIG. 1 structure was adapted. The small amount of extra wrap on rollers 3 and 5 occurring as a result of the positioning of intermediate image member 20 also does not appear to adversely affect this system.

Figure 4:
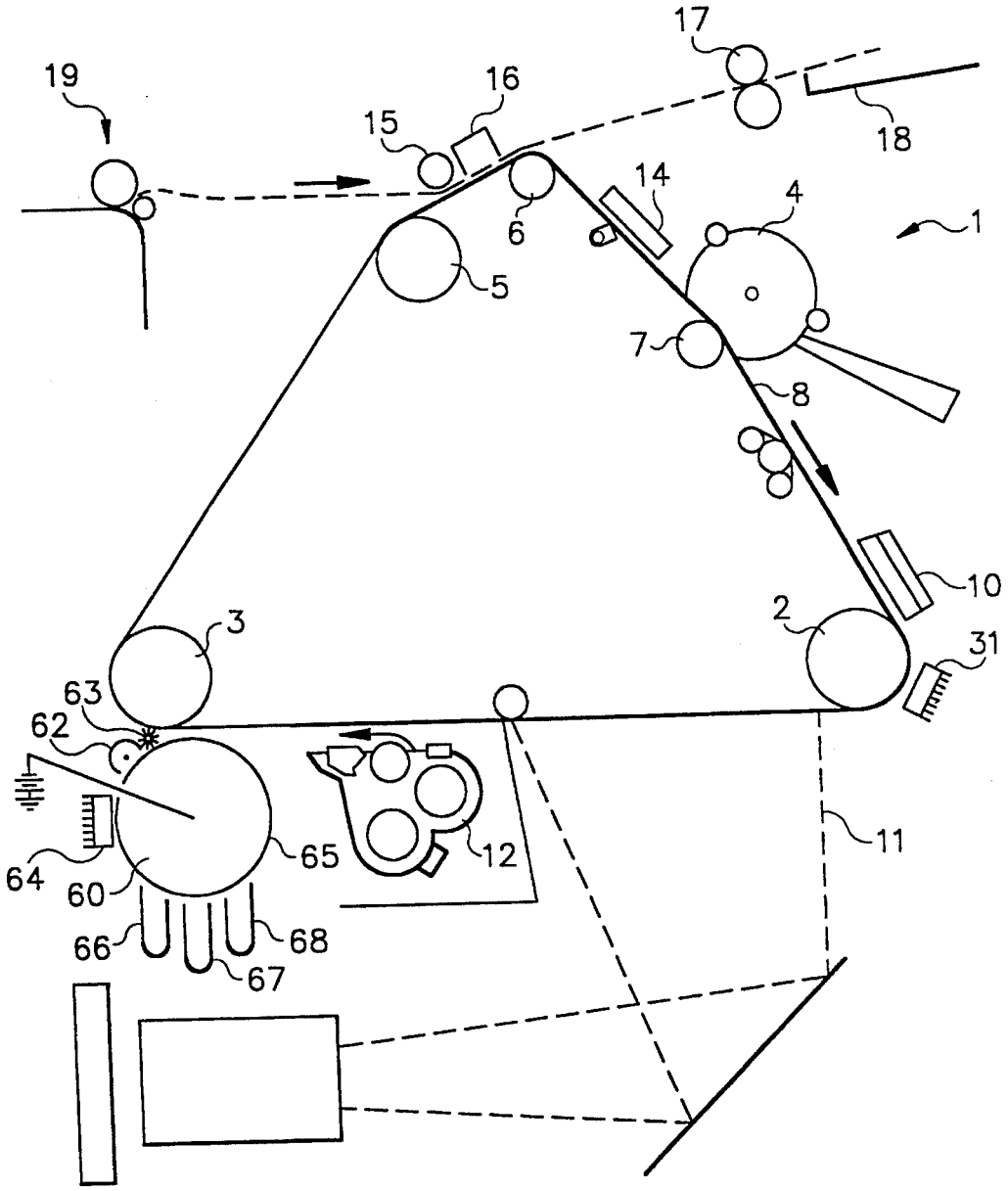

FIG. 4 shows a technically quite different but effectively somewhat similar approach to providing color images. In this instance, the intermediate image member 20 and the second toning station of FIG. 1 are replaced by an auxiliary image member, for example, a photoconductive drum 60 which is rotatable past its own series of image forming stations. The stations include a charging station 62, an electronic printhead, for example, an LED printhead 64 and a series of color toning stations 66, 67 and 68. A cleaning station 63 and a transfer nip 65 are also provided. When working with a computer, a memory or a scanner, LED printhead 64 forms an electrostatic image on image member 60 which is toned by one of toning stations 66, 67 or 68 to form a color toner image. That color toner image can be transferred to primary image member 8 in registration with a black toner image created by either or both of flash exposure device 11 or electronic exposure station 31 and black development station 12.

In a more sophisticated embodiment of the FIG. 4 apparatus, two or three images are formed in registration with each other on member 60 before transfer, each with toner from a different one of the toning stations. This can be used to create a three color image. In this embodiment, discharged area development is preferred and the formation of three images would take three revolutions of auxiliary image member 60 which would need to be one frame in intrack circumference. Note that if the auxiliary image member 60 moves at the same speed as primary image member 8, approximately three frames would pass while a three color image was formed on auxiliary image member 60. In some jobs, these three frames could be used for producing black images, but this approach would not fit most jobs. In its simplest form, where only one image of the three colors from stations 66, 67 and 68 is added to a black image, no skip frames are required. It, thus, operates at the same machine speed as the machine operates for single color (black) imaging.

The invention has been described in detail with particular reference to a preferred embodiment thereof, but it will be understood that variations and modifications can be effected within the spirit and scope of the invention as described hereinabove and as defined in the appended claims.

I claim:

1. A method of forming combined toner images on a primary image member being driven through an endless path, said method comprising:

forming a first toner image on the primary image member, forming a second toner image on the primary image member, transferring the first toner image to an intermediate image member and then back to the primary image member in registration with the second toner image by applying electrical fields between the image members of directions which urge the toner image to transfer first to the intermediate image member and then back to the primary image member, and driving the intermediate image member for movement with respect to the primary image member solely through frictional contact between the image members, the electrical fields contributing to the frictional contact between the image members.

2. The method according to claim 1 further including the step of transferring the combined first and second images to a receiving sheet and cleaning residual toner from the primary image member.

3. The method according to claim 1 wherein the steps of forming the first and second toner images include forming first and second toner images of different color.

4. The method according to claim 1 further including the step of transferring any residual toner left on the intermediate image member after transfer to the first toner image back to the primary image member to a portion of the primary image member upstream of the second toner image.

5. Image forming apparatus comprising:

an endless belt primary image member, an intermediate image member comprising a cylindrical roller positioned in engagement with the primary image member with said primary image member wrapping around a portion of the intermediate image member, means for moving the primary image member through an endless path past a series of image forming stations, said intermediate image member being positioned to engage the primary image member with sufficient frictional contact to be frictionally driven by movement of the primary image member, means for forming first and second toner images on different portions of the primary image member, and means for transferring the first toner image to the intermediate image member and then back to the primary image member in registration with the second toner image to form a combined toner image on the primary image member.

6. The image forming apparatus according to claim 5 wherein there is no backing member contacting the primary image member where it wraps the intermediate image member.

7. The image forming apparatus according to claim 5 further including corona charging means positioned to apply a charge to the intermediate image member when it is holding the first toner image to make that toner image more easy to transfer back to the primary image member.

8. The image forming apparatus according to claim 5 further including means for transferring the combined toner image to a receiving sheet.

9. The image forming apparatus according to claim 8 wherein said means for transferring to a receiving sheet includes a transfer roller positioned to form a nip with the primary image member and means for feeding a receiving sheet into said nip and means for applying a transferring bias to said transfer roller which means is adjustable to a first condition in which it creates a field urging transfer of the combined image to the receiving sheet and a second condition in which it inhibits transfer of residual toner to the transfer roller when no receiving sheet is present in the nip.

10. The image forming apparatus according to claim 5 wherein said means for forming first and second toner images includes means for imagewise flash exposing the primary image member, which means includes means for varying the time between said flash exposures for the first and the second images and means for controlling said time to control the registration of the first and second images despite changes in ambient conditions.

11. Image forming apparatus comprising:

an endless belt primary image member, an intermediate image roller positioned in engagement with the primary image member, means for moving the primary image member through an endless path past a series of image forming stations, means for forming first and second toner images on the primary image member, means for forming an electrical field, said means having a first condition in which the field is of a direction and strength to transfer the first toner image to the intermediate image roller and a second condition in which the field is of a direction and strength to transfer the first toner image back to the primary image member in registration with the second toner image to form a combined toner image on the primary image member, wherein, the primary image member and the intermediate image roller have surfaces that are sufficiently unattractive to the toner to permit transfer in both directions under the electrical fields but have sufficient friction, with the assistance of the electrical fields, that the intermediate image roller is driven entirely by frictional contact with the primary image member.

12. Image forming apparatus according to claim 11 including means for forming uncombined toner images and wherein the means for forming an electrical field has a third condition in which the field inhibits transfer of an uncombined toner image to the intermediate image roller while the roller is being driven by the primary image member.

13. Image forming apparatus according to claim 12 wherein the primary image member wraps the intermediate image roller enough to allow driving of the intermediate image member by the primary image member with pressure between the intermediate image roller and the primary image member sufficiently low to inhibit transfer of an uncombined image member to the intermediate image roller when the means for forming an electrical field is in its third condition.

14. Image forming apparatus comprising:

a primary image member, an intermediate image member positioned in transfer relation with the primary image member, means for forming first and second toner images electrostatically held to the primary image member, means for transferring the first toner image, first to the intermediate image member and then back to the primary image member in registration with the second toner image, means for reducing the electrostatic attraction between the first toner image and the primary image member before transfer to the intermediate image member, and means for disabling the reducing means to not reduce the electrostatic attraction between the primary image member and the second toner image.

15. Image forming apparatus according to claim 14 wherein the reducing means is an erase lamp that is turned off when passed by the second toner image.

16. Image forming apparatus according to claim 14 further including means for forming uncombined toner images on the primary image member, which are not transferred to the intermediate image member and are not combined with another toner image, and wherein said reducing means is an erase lamp that is turned off when passed by said uncombined toner images.

17. A method of forming combined toner images on a primary image member being driven through an endless path, said method comprising:

forming a first toner image on the primary image member, forming a second toner image on the primary image member, transferring the first toner image to an intermediate image member formed as a roller having a thin metallic core covered with a thin layer of a relatively hard semiconductive material having a Youngs modulus in excess of $5\times10^7/m^2$ and then back to the primary image member in registration with the second toner image, and driving the intermediate image member for movement with respect to the primary image member solely through frictional contact between the image members.

18. The method according to claim 17 wherein the primary image member has a toner image bearing surface having a Youngs modulus in excess of $5\times10^7$ Newtons/$m^2$.

19. A method of forming combined toner images on a primary image member being driven through an endless path, said method comprising:

forming a first toner image on the primary image member, forming a second toner image on the primary image member, transferring the first toner image to an intermediate image member comprising a roller having a thin metallic core covered by an inner layer of material having a Youngs modulus between $10^5$ and $10^7$ Newtons/$m^2$ and a thin outer layer on said inner layer of material having a Youngs modulus in excess of $5\times10^7$ Newtons/$m^2$ and then back to the primary image member in registration with the second toner image, and driving the intermediate image member for movement with respect to the primary image member solely through frictional contact between the image members.

20. A method of forming combined toner images on an endless belt primary image member which has a toner image bearing surface having a Youngs modulus in excess of $5\times10^7$ Newtons/$m^2$ and which is driven through an endless path, said method comprising:

forming a first toner image on the primary image member, forming a second toner image on the primary image member, transferring the first toner image to an intermediate image member and then back to the primary image member in registration with the second toner image by applying electrical fields between the image members of directions which urge the toner image to transfer first to the intermediate image member and then back to the primary image member, and driving the intermediate image member for movement with respect to the primary image member solely through frictional contact between the image members, the electrical fields contributing to the frictional contact between the image members.

21. The method according to claim 20 wherein the Youngs modulus of the toner image bearing surface of the primary imaging member is in excess of $10^8$ Newtons/$m^2$ and the step of transferring the first toner image to the intermediate image member includes transferring said first toner image to a surface having a Youngs modulus in excess of $5\times10^7$ Newtons/$m^2$.

22. The method according to claim 21 wherein the intermediate image member is a roller and the step of driving the intermediate image member includes wrapping the intermediate image member with the primary image member by an amount sufficient to drive the intermediate image member without a backup member directly opposite the intermediate image member.

23. The method according to claim 22 wherein the wrap is about 10° of the intermediate image member.

24. Image forming apparatus comprising:

a primary image member having a contact surface, an intermediate image member having a contact surface positioned to engage the contact surface of the primary image member, with both of the contacting surfaces having a Youngs modulus in excess of $5\times10^7$ Newtons/$m^2$, means for moving the primary image member through an endless path past a series of image forming stations, said intermediate image member being positioned to engage the primary image member with sufficient frictional contact to be frictionally driven by movement of the primary image member, means for forming first and second toner images on different portions of the primary image member, and means for transferring the first toner image to the intermediate image member and then back to the primary image member in registration with the second toner image to form a combined toner image on the primary image member.

25. Image forming apparatus comprising:

a primary image member, an intermediate image member positioned in engagement with the primary image member, means for moving the primary image member through an endless path past a series of image forming stations, said intermediate image member being positioned to engage the primary image member with sufficient frictional contact to be frictionally driven by movement of the primary image member, means for forming first and second toner images on different portions of the primary image member, means for transferring the first toner image to the intermediate image member and then back to the primary image member in registration with the second toner image to form a combined toner image on the primary image member, and logic and control for controlling image formation on said moving primary image member to form the first toner image and second toner image in consecutive portions in an in-track direction of the image member and to leave a non-image space at least equal in the in-track direction to the length of the first image after the formation of the second image, and means for transferring to the non-image space residual toner left on the intermediate image member after transfer of the first image back to the primary image member.

26. The image forming apparatus according to claim 25 wherein no additional means is provided for cleaning said intermediate image member between images.

27. Image forming apparatus comprising:

a primary image member, an intermediate image member positioned in engagement with the primary image member, means for moving the primary image member through an endless path past a series of image forming stations, said intermediate image member being positioned to engage the primary image member with sufficient frictional contact to be frictionally driven by movement of the primary image member, means for forming first and second toner images on different portions of the primary image member, means for transferring the first toner image to the intermediate image member and then back to the primary image member in registration with the second toner image to form a combined toner image on the primary image member, and a reversible power source for creating a reversible electric field between the primary image member and the intermediate image member to effect the transfer of the first toner image between the image members and to assist in maintaining a non-slip engagement between the image members.

28. Image forming apparatus comprising:

a primary image member, an intermediate image member positioned in engagement with the primary image member, means for moving the primary image member through an endless path past a series of image forming stations, said intermediate image member being positioned to engage the primary image member with sufficient frictional contact to be frictionally driven by movement of the primary image member, means for forming first and second toner images on different portions of the primary image member, means for transferring the first toner image to the intermediate image member and then back to the primary image member in registration with the second toner image to form a combined toner image on the primary image member, and means for inhibiting the transfer of toner images from the primary image member to the intermediate image member while the intermediate image member is in engagement with the primary image member to permit the image forming apparatus to form uncombined toner images without disengaging the intermediate image member from the primary image member.

* * * * *

UNITED STATES PATENT AND TRADEMARK OFFICE

CERTIFICATE OF CORRECTION

PATENT NO. : 5,485,256
DATED : January 16, 1996
INVENTOR(S) : Kent A. Randall, et al It is certified that error appears in the above-indentified patent and that said Letters Patent is hereby corrected as shown below:

Column 12, line 8, delete "$5x10^7/m^2$" and substitute ---$5 \times 10^7$ Newtons/$m^2$---.

Signed and Sealed this

Eleventh Day of June, 1996

*Attest:*

BRUCE LEHMAN

*Attesting Officer*

*Commissioner of Patents and Trademarks*